US007427238B1

(12) United States Patent
Oprandi et al.

(10) Patent No.: US 7,427,238 B1
(45) Date of Patent: Sep. 23, 2008

(54) GOLF CLUB SWINGING GUIDE

(76) Inventors: Arthur V. Oprandi, 385 N. Point Rd. 1001, Osprey, FL (US) 34229; Lisa Fitzgerald, 8337 Silo Ct., Sarasota, FL (US) 34240

( * ) Notice: Subject to any disclaimer, the term of this patent is extended or adjusted under 35 U.S.C. 154(b) by 0 days.

(21) Appl. No.: 11/881,314

(22) Filed: Jul. 26, 2007

(51) Int. Cl.
*A63B 69/36* (2006.01)

(52) U.S. Cl. ..... 473/223; 473/221

(58) Field of Classification Search ..... 473/219, 473/221, 222, 223, 224, 226, 228, 229, 231, 473/238, 266, 269
See application file for complete search history.

(56) References Cited

U.S. PATENT DOCUMENTS

| | | | | |
|---|---|---|---|---|
| 3,298,693 | A * | 1/1967 | Eisenberg | 473/238 |
| 4,789,160 | A | 12/1988 | Dollar, Jr. et al. | |
| 4,949,971 | A * | 8/1990 | Thornton | 473/238 |
| 5,082,283 | A | 1/1992 | Conley et al. | |
| 5,233,544 | A | 8/1993 | Kobayashi | |
| 5,277,428 | A | 1/1994 | Goodwin et al. | |
| 5,527,039 | A | 6/1996 | Levesque | |
| 5,762,564 | A * | 6/1998 | Schang | 473/238 |
| 6,607,450 | B1 | 8/2003 | Hackman | |
| 6,692,370 | B2 | 2/2004 | Koncelik, Jr. | |
| 6,699,138 | B1 | 3/2004 | Lin | |
| 6,739,981 | B1 | 5/2004 | Lin | |
| 6,843,731 | B1 | 1/2005 | Oprandi | |
| 7,021,140 | B2 | 4/2006 | Perkins | |
| 2005/0107180 | A1 | 5/2005 | Halleck et al. | |

* cited by examiner

*Primary Examiner*—Nini Legesse
(74) *Attorney, Agent, or Firm*—Charles J. Prescott

(57) ABSTRACT

A golf club swinging guide releasably attachable to a lower end of a golf club shaft. The guide includes a housing having a stationary member with an alignment portion which is adjustably alignable perpendicular to the striking face of the golf club head. A wind vane is connected for free rotation to the housing about an upright axis of rotation oriented generally parallel to the club shaft. The wind vane, being responsive to movement of air, thereby visually aligns itself to the direction that the golf club is swung. Visual misalignment between the stationary portion and the actual direction of golf club swing at the moment of golf ball impact is discerned by an electronic circuit within the housing producing a sensorially perceivable output.

4 Claims, 11 Drawing Sheets

Figure 2
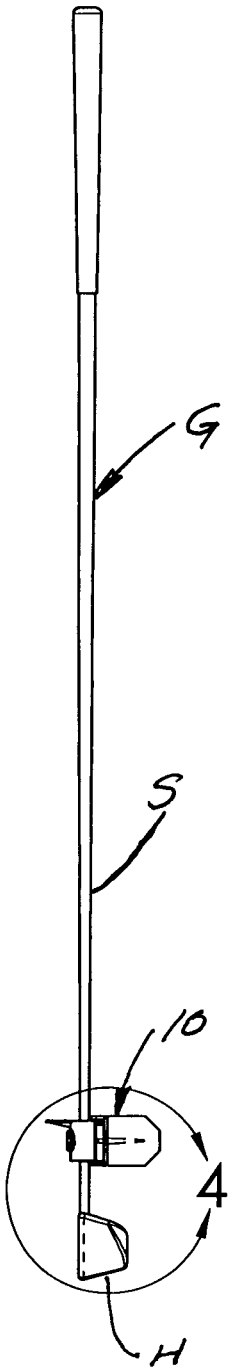
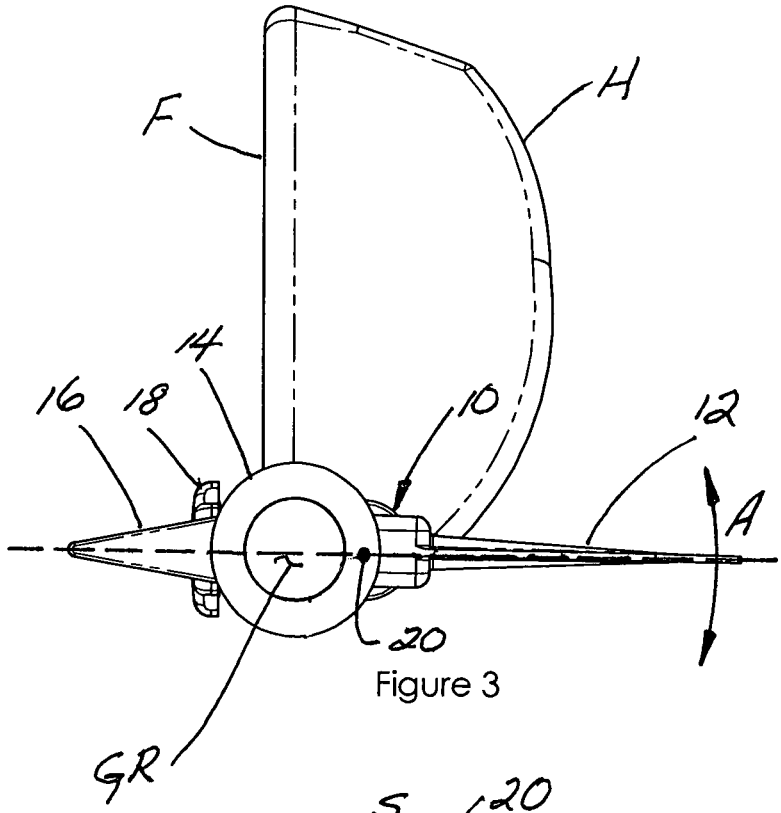
Figure 3
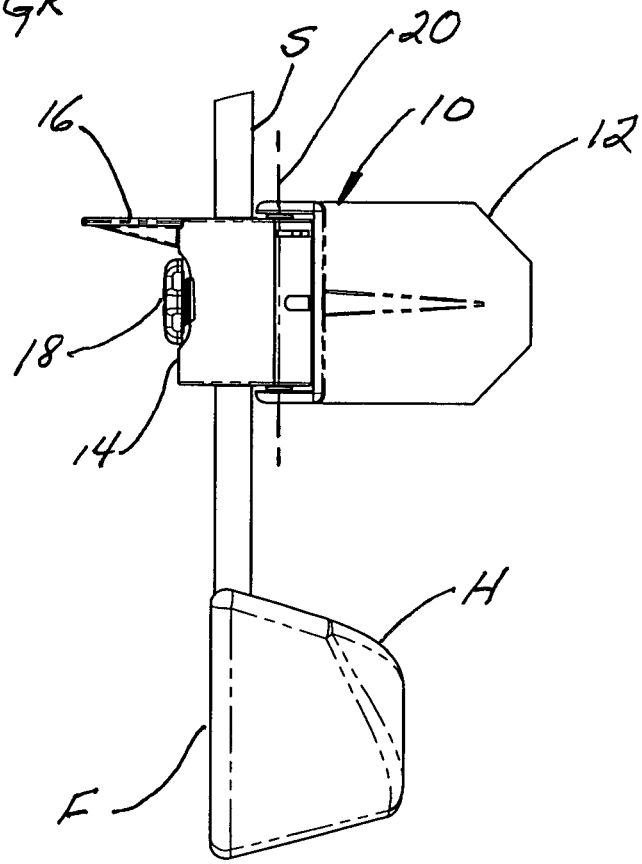
Figure 4

GOLF CLUB SWINGING GUIDE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to practice and corrective devices associated with the golf swing and the game of golf and more particularly to a golf club swinging guide which provides immediate audible indicia reflective of any misalignment between the golf swing itself and the direction the striking face of the golf club head faces at the moment of golf ball impact.

2. Description of Related Art

The world of golf has attracted a vast mountain of players, competitors and golf club equipment, not to mention the vast investment in golf courses themselves. However, the game of golf is premised upon a golf swing which is at best unnatural. Developing a correct swing for consistent power and accuracy is the ultimate challenge of every golfer.

One aspect of this golf swing perfection challenge is to cause the golf club striking face to strike the golf ball in a line of movement and with a club face striking face orientation which will propel the golf ball in a desired direction and with the desired amount of hook, slice or straight flight characteristics. One patent disclosure by Johnson in U.S. Pat. No. 5,143,376 has provided such a golf club swinging guide. This invention by Johnson provides a swinging guide somewhat permanently clampable onto the lower end of the golf shaft of the golf club and provides a vane pivotally connected to that mount. The vane is freely pivotal and responsive to movement of air so that the vane visibly aligns itself in the direction of the golf club swing.

A broad array of additional U.S patented devices also provide some means for visually aligning the striking face of the golf club head with the golf ball on a more static pre-swing basis as follows:

U.S. Pat. No. 4,789,150 Chiesa
U.S. Pat. No. 1,712,609 Gibson
U.S. Pat. No. 2,652,251 Molinar
U.S. Pat. No. 3,198,525 Smith
U.S. Pat. No. 3,262,705 Nunziato
U.S. Pat. No. 3,298,693 Eisenberg
U.S. Pat. No. 3,719,363 Harrison
U.S. Pat. No. 4,576,378 Backus
U.S. Pat. No. 4,949,971 Thornton
U.S. Pat. No. 5,071,129 Wilson
U.S. Pat. No. 5,351,962 Lin
U.S. Pat. No. 5,605,509 Gray
U.S. Pat. No. 5,762,564 Schang
U.S. Pat. No. D347,457 Armstrong A previous U.S. Pat. No. 6,843,731 provides a substantial improvement over the Johnson '376 swinging guide in that many of the forces associated with the high velocity and arcuate movement of a golf club head are somewhat neutralized in my '731 patent over the Johnson device so that a more accurate indication of misalignment at the moment of golf ball impact is viewable. Further, a means for temporarily locking the misalignment relationship at the moment of golf ball impact is also provided.

The present invention provides still further improvement in an electronic/mechanical golf club swing guide by substantially reducing the mass and inertia factors which must be dealt with during a typical golf swing and further which provides for electronic swing analysis and audible output at the moment of impact to indicate to the golfer whether the swing was correct.

BRIEF SUMMARY OF THE INVENTION

This invention is directed to an electronic/mechanical golf club swinging guide releasably attachable to a lower end of a golf club shaft. The guide includes a housing releasably connectable to the golf club shaft and having a laterally extending stationary member defining a longitudinal intended line of flight which, when adjustably aligned perpendicular to the striking face of the golf club head, automatically identifies the intended line of flight. A wind vane is connected for free rotation to the housing about the axis of rotation which is parallel to and spaced in close proximity to the shaft. The wind vane extends laterally from the housing away from the stationary members whereby the wind vane is responsive to movement of air to visually align itself in the direction that the golf club is swung. Misalignment between the stationary member and the direction of golf club swing is thus electronically measured during each golf club swing. Momentary detection of this misalignment (or proper alignment) is fixed at the instant of golf ball impact and an audible (or viewable) signal so advises the golfer.

It is an object of this invention to provide a golf club swinging guide offering immediate audible (or viewable) indicia to the golfer related to the relative orientation of the golf club striking face to the actual direction of swing at the moment of golf ball impact.

Still another object of this invention is to provide an audible (or viewable) signal of misalignment between the direction of the golf ball swing and the orientation of the golf ball striking face of a golf club head at the very moment of golf ball impact.

Yet another object of his invention is to provide a means for temporarily locking the electronic signal of misalignment (or proper alignment) between the golf club swing direction and the orientation of the striking face of the golf club head which may be heard (or viewed) then released after the swing.

Still another object of this invention is to provide a golf club swinging guide releasably attachable to the lower end of the shaft of the golf club which is substantially less influenced by centrifugal and inertial change forces of the club head and lower shaft to provide a more accurate electronic indication of misalignment between the golf club swing direction and the orientation of the striking face of a golf club head at the precise movement of golf ball impact.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 2 is a front elevation view of FIG. 1.

FIG. 3 is a top plan view of FIG. 2 along the axis of the golf club shaft.

FIG. 4 is an enlarged view of area 4 in FIG. 2.

DETAILED DESCRIPTION OF THE INVENTION

Figure 1:
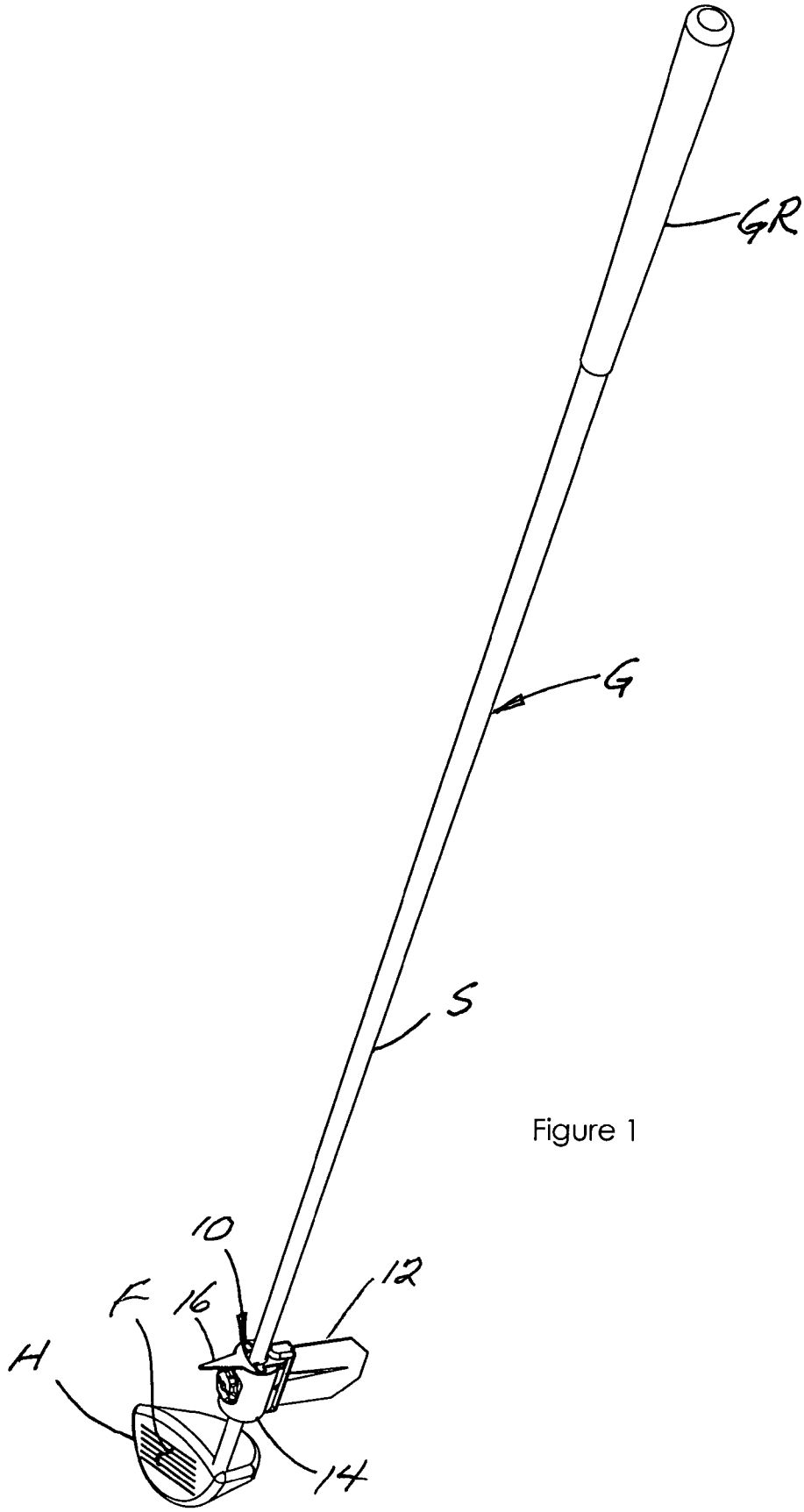
FIG. 1 is a perspective view of a golf club showing the device attached to the lower end of the shaft of the golf club.

Referring now to the drawings, and firstly to FIGS. 1 to 6, the preferred embodiment is there shown generally at numeral 10 attached to the lower end of the shaft S of a golf club G opposite the grip end GR. The swing guide 10 is releasably attachable as shown in FIGS. 1 and 4 just above the head H of the golf club G.

The swing guide 10 includes a freely pivotally movable or swingable wind vane 12 having a generally flat or planar configuration and pivotally connectable to the housing 14 about an upright pivotal axis 20 which is oriented generally parallel to and in proximity to the longitudinal axis of the shaft S when the device is attached to the shaft S. As will be described more fully herebelow, the housing 14 is releasably attachable around the shaft S and made secure by tightening of threaded knob 18 which bears against the shaft S. An elongated stationary member or pointer 16 laterally extends from the housing 14 in the direction opposite to that of the wind vane 12 and is fixedly connected to the housing 14. Upon installation of the housing 14 around the shaft S, as best seen in FIG. 3, the stationary member 16 is alignable perpendicular to the face F of the golf head H and, when the wind vane 12 is oriented in the exact opposite direction or 180° opposite that of the stationary member 16, an imaginary plane shown in dashed line in FIG. 3 centrally passes through the stationary member 16, the axis of rotation 20, and the plane of the wind vane 12. Of course, the wind vane 12 must be freely pivotable about the pivotal axis 20 in the direction of arrow A on a minimal friction basis to maximize the accuracy of the swing guide 10.

Figure 5:
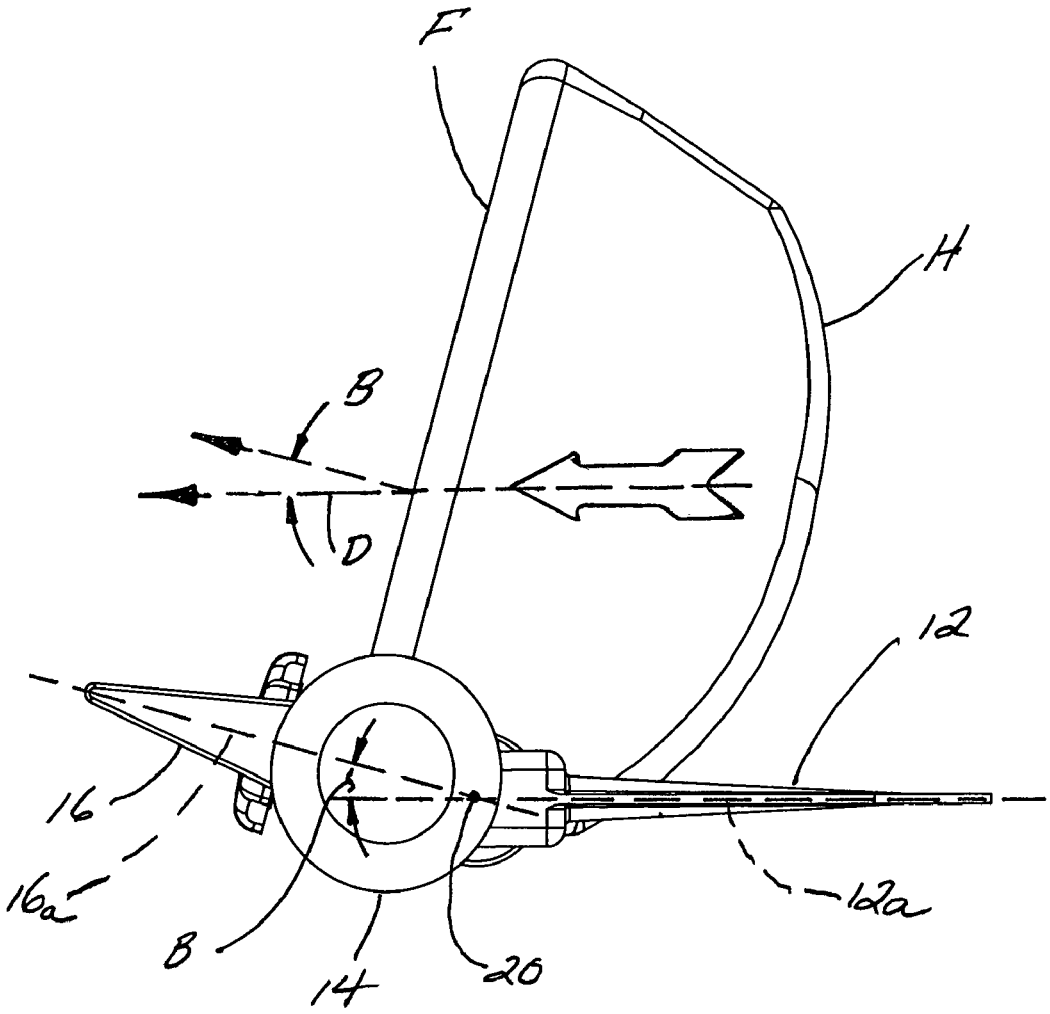
FIG. 5 is an enlarged view of FIG. 3 depicting one condition of misalignment of the golf club head to the direction of swing.
Figure 6:
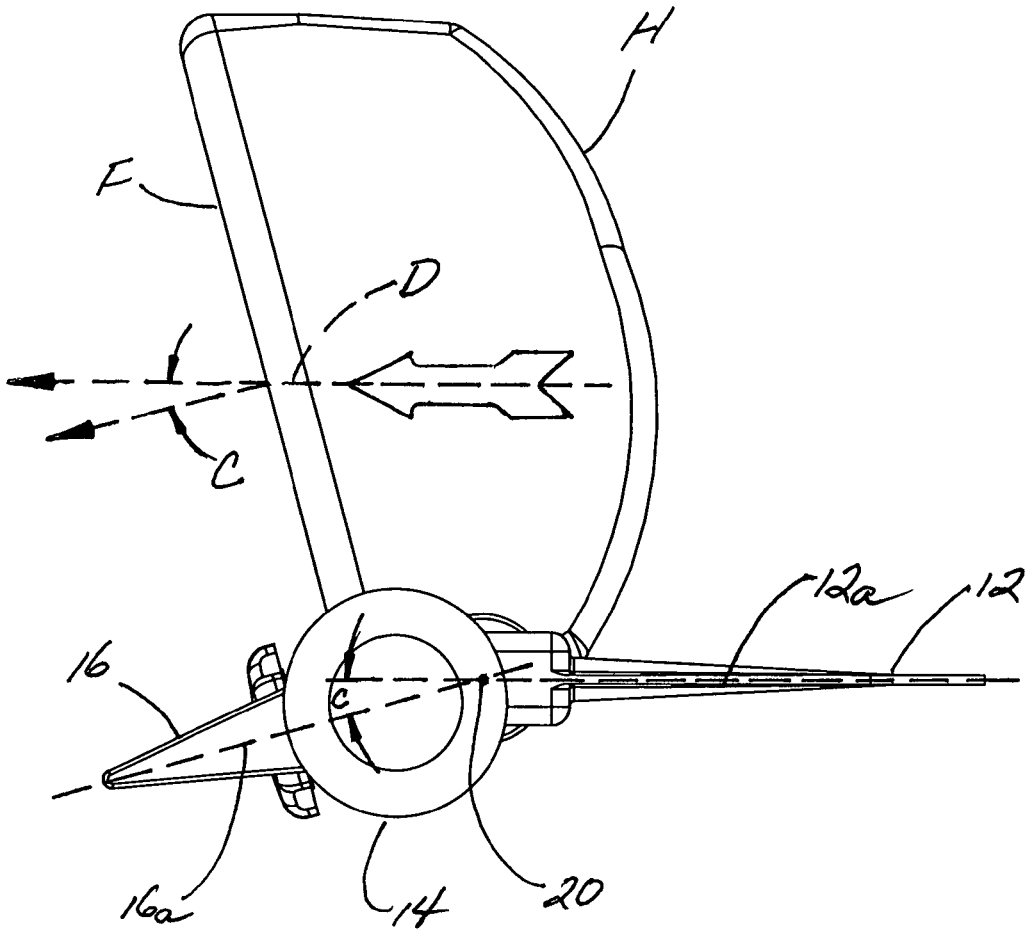
FIG. 6 is a view similar to FIG. 3 showing another condition of misalignment of the golf club head to the direction of swing.

Referring particularly to FIGS. 5 and 6, the wind vane 12 will freely pivot or swing about the axis of rotation 20 so as to be oriented by air movement with the actual movement of the head H of the golf club G, this direction of swing being indicated by the large arrow D. However, in FIG. 5, the face F of the club head H is not orthogonally oriented to the direction of swing D. Rather, the club face F is turned outwardly as indicated by the axis 16*a* of the stationary member 16. Thus, an outside deviation angle B reflects the out-of-alignment of the clubface F to the direction of swing D.

In FIG. 6, the club face F is turned inwardly about the shaft S of the golf club G which produces an inside deviation or error between the direction of swing along arrow D and the longitudinal axis 16*a* of the stationary member 16, the deviation being shown at angle C. In both of these cases shown in FIGS. 5 and 6, the golfer may expect the flight path of the golf ball struck with the clubface F in either of these orientations to substantially deviate from an intended line of flight which would have been produced if the clubface F had been oriented precisely orthogonally to the direction of swing at the moment of clubface-to-ball impact shown by the arrow D.

Figure 7:
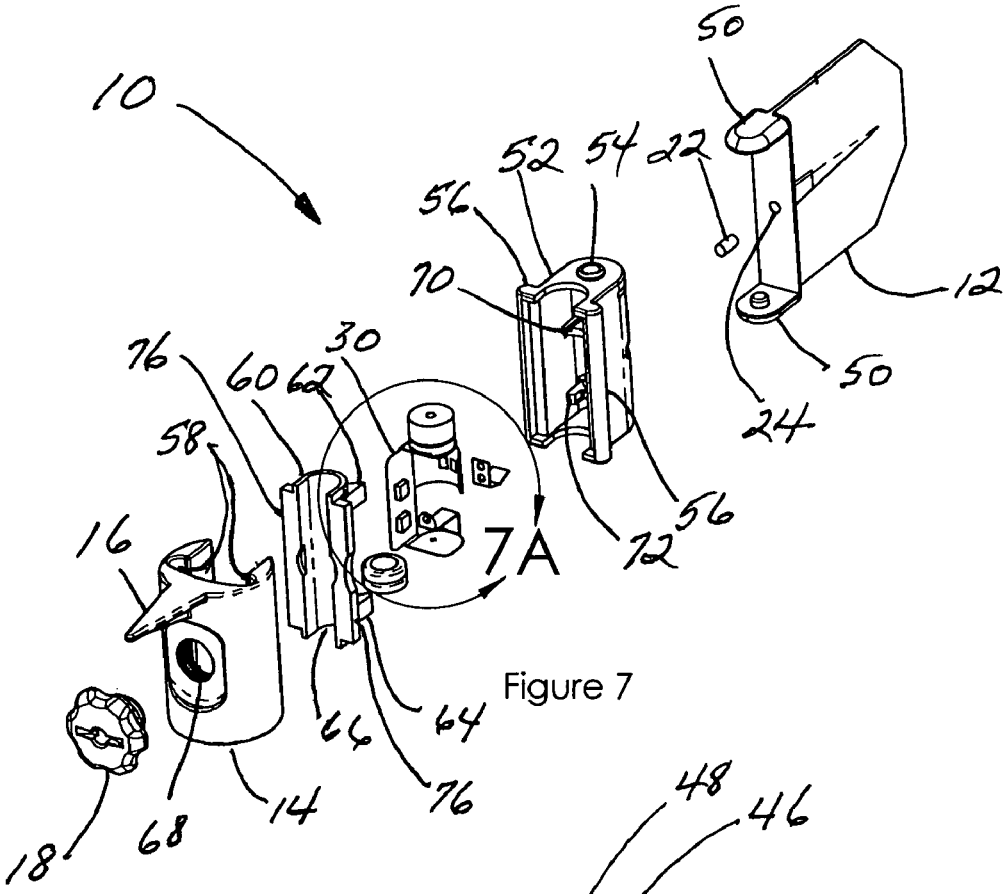
FIG. 7 is an exploded perspective view of the preferred embodiment.
Figure 7A:
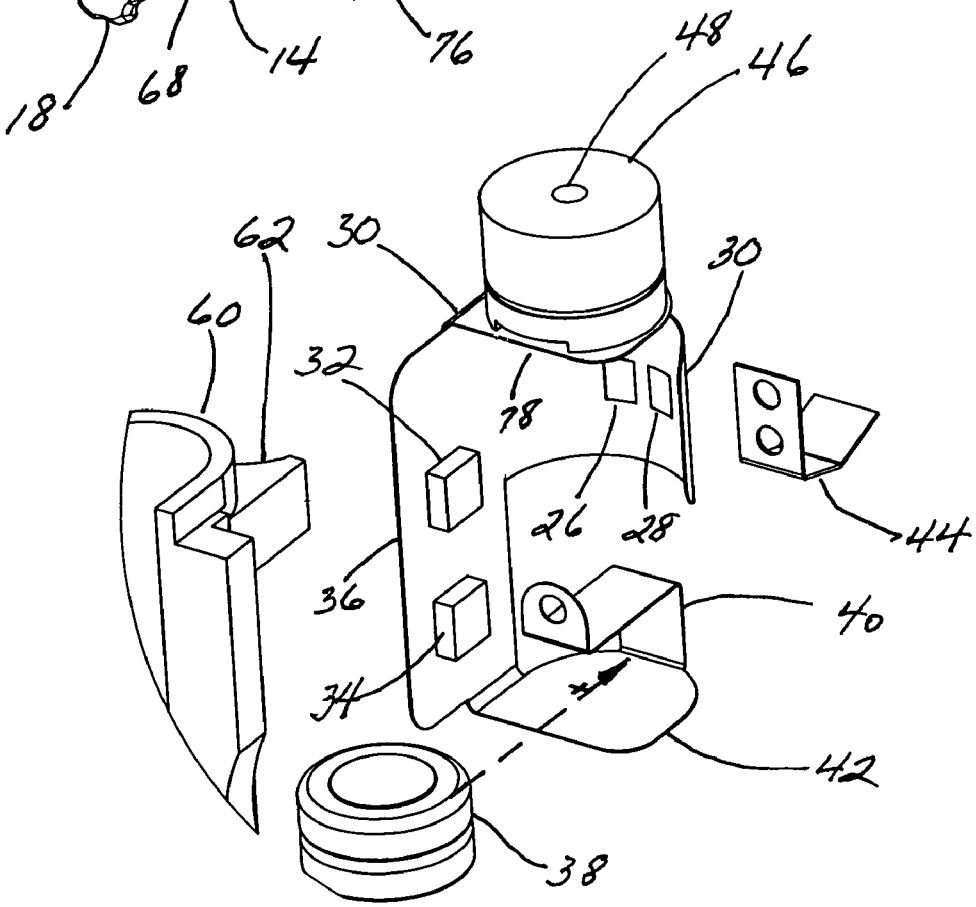
FIG. 7A is an enlargement of area A of FIG. 7.
Figure 8:
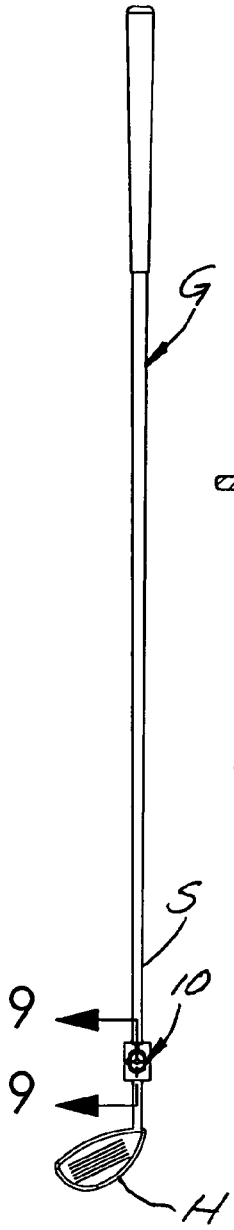
FIG. 8 is a side elevation view of FIG. 1.
Figure 9:
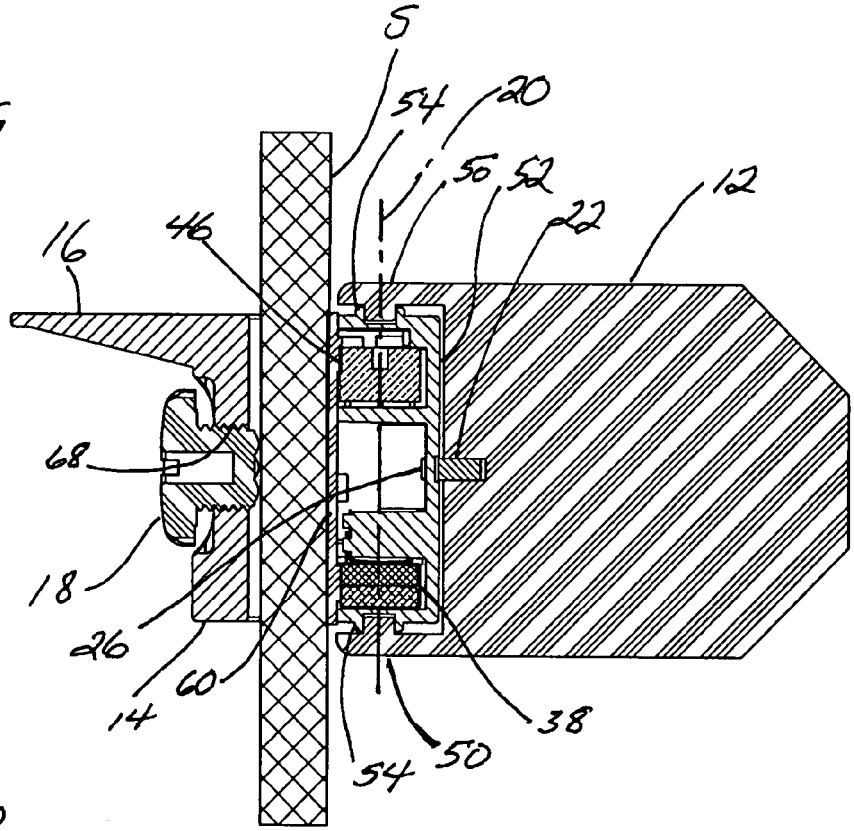
FIG. 9 is a section view in the direction of arrows 9-9 in FIG. 8.

Referring now to FIGS. 7 and 7A, an exploded view of the preferred embodiment 10 is there shown. The housing 14, having the laterally extending stationary member 16, includes a rear housing portion 52 which slidably engages into inward facing grooves 58 formed lengthwise of housing 14 by outwardly facing longitudinal ribs 56 as best seen for interengagement therebetween in FIG. 11. The housing 14 and rear housing portion 52 are preferably formed of molded glass nylon having a 20% fill.

A resilient rubber dampener 60 formed of molded SANTOPRENE TPV101-64 is fitted between and generally coextensive with the housing 14 and the rear housing portion 52 to tightly grip against the shaft S to isolate the electronics portion described herebelow from impact damage created by the repeated striking of a golf ball by the head H of the golf club G.

A flexible polyamide circuit board carrier 30, as will be described in more detail herebelow, is fitted into the hollow interior of the housing portion 52 and includes two spaced apart Hall Effects sensors 26 and 28, an accelerometer 34, and a CPU 32 attached thereto. Batteries 38 fit between contact pad 42 and ground strap 40 held in place by contact spring 44 which in turn is held within support 72 of the rear housing portion 52. An audible buzzer 46 is positioned against contact tab 78 and emits sound through opening 48 responsive to output of the electronic circuit described herebelow. Saddle portions 62 of the rubber dampener 60 bear against and hold the buzzer 46 and the batteries 38 in operative position at either end of the printed circuit board carrier 30 and within the housing portion 52.

The wind vane 12 includes ears 50 each having cavities formed into the inner facing surfaces thereof which supportively receive bosses 54 of rear housing portion 52 to establish the free pivotal axis 20 of the wind vane 12. A cylindrical magnet 22 is embedded into cavity 24 of the wind vane 12 and interacts with the Hall Effects sensors 26 and 28 which will be described herebelow.

Referring now to FIGS. 8 to 11A, the housing 14 is shown being held against the shaft S by knob 18 which is threadably tightenable into threads 68 by proper rotation thereof, the friction contact 74 bearing against the shaft S so as to help prevent rotation of the housing 14 with respect to the shaft S during golf club G swinging. Again, the rubber dampener 60 adds frictional engagement against the shaft S to further inhibit unintended movement either longitudinally of, or rotationally with respect to the shaft S.

Figure 11A:
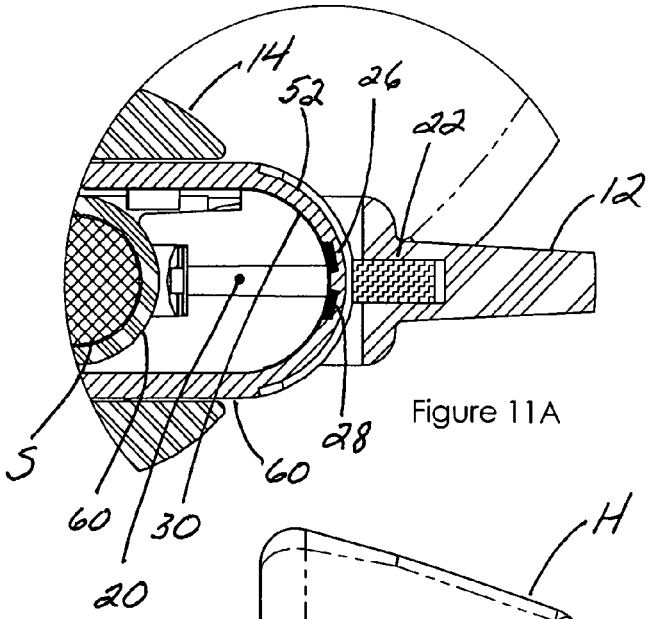
FIG. 11A is an enlargement of area A of FIG. 11.
Figure 10:
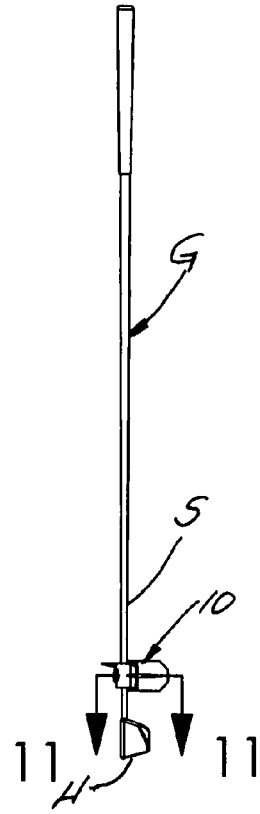
FIG. 10 is a front elevation view of FIG. 1 orthogonal to the golf club shaft.
Figure 11:
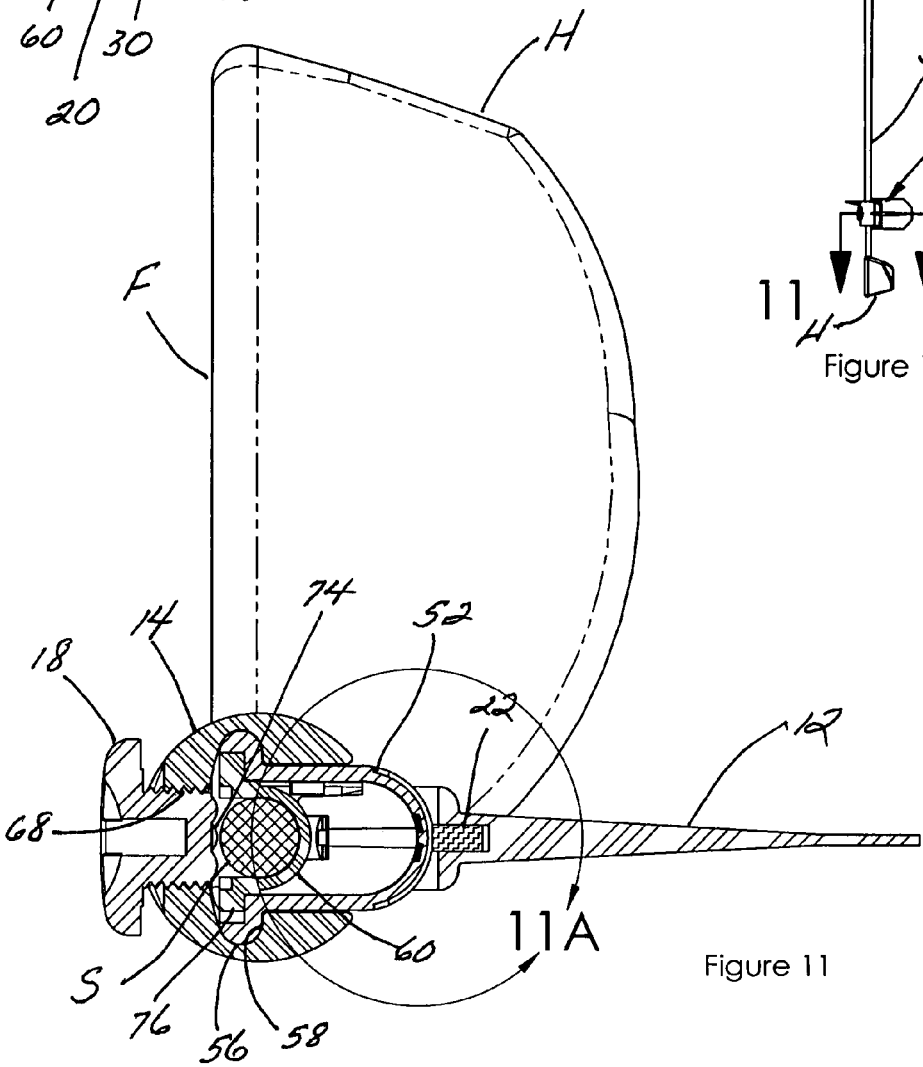
FIG. 11 is a section view in the direction of arrows 11-11 of FIG. 10.

In the orientation of the wind vane 12 shown in FIGS. 11 and 11A, the exposed end of the cylindrical magnet 22 is positioned equidistant between the Hall Effects sensors 26 and 28. In this orientation of the wind vane 12, which corresponds to that shown in FIG. 3 described hereinabove, the electronic circuit, being controlled in output signal by this relationship of the magnet 22 and Hall Effects sensors 26 and 28, indicates a straight or planer alignment between the wind vane 12 and the stationary member 16 and its orthogonal relationship to the face F of the head H.

Figure 13A:
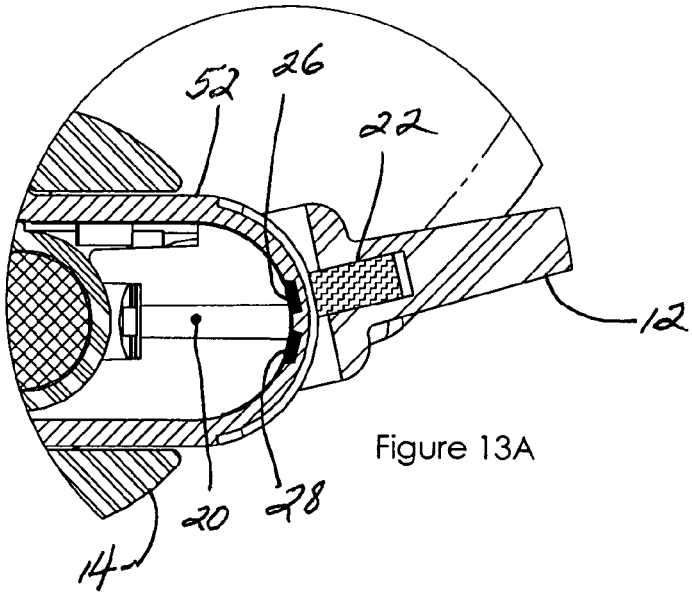
FIG. 13A is an enlargement of area 13A of FIG. 13.
Figure 12:
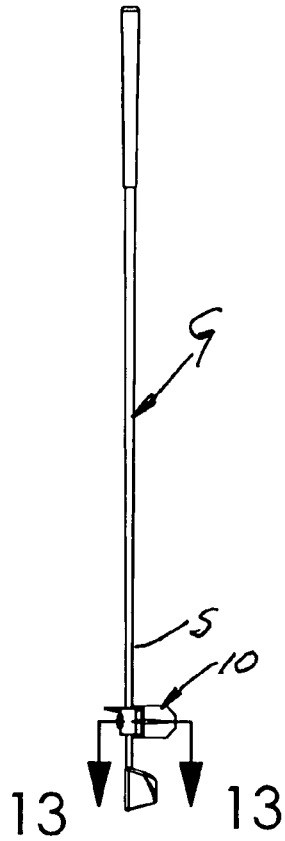
FIG. 12 is a view similar to FIG. 11 showing the condition of misalignment depicted in FIG. 5.
Figure 13:
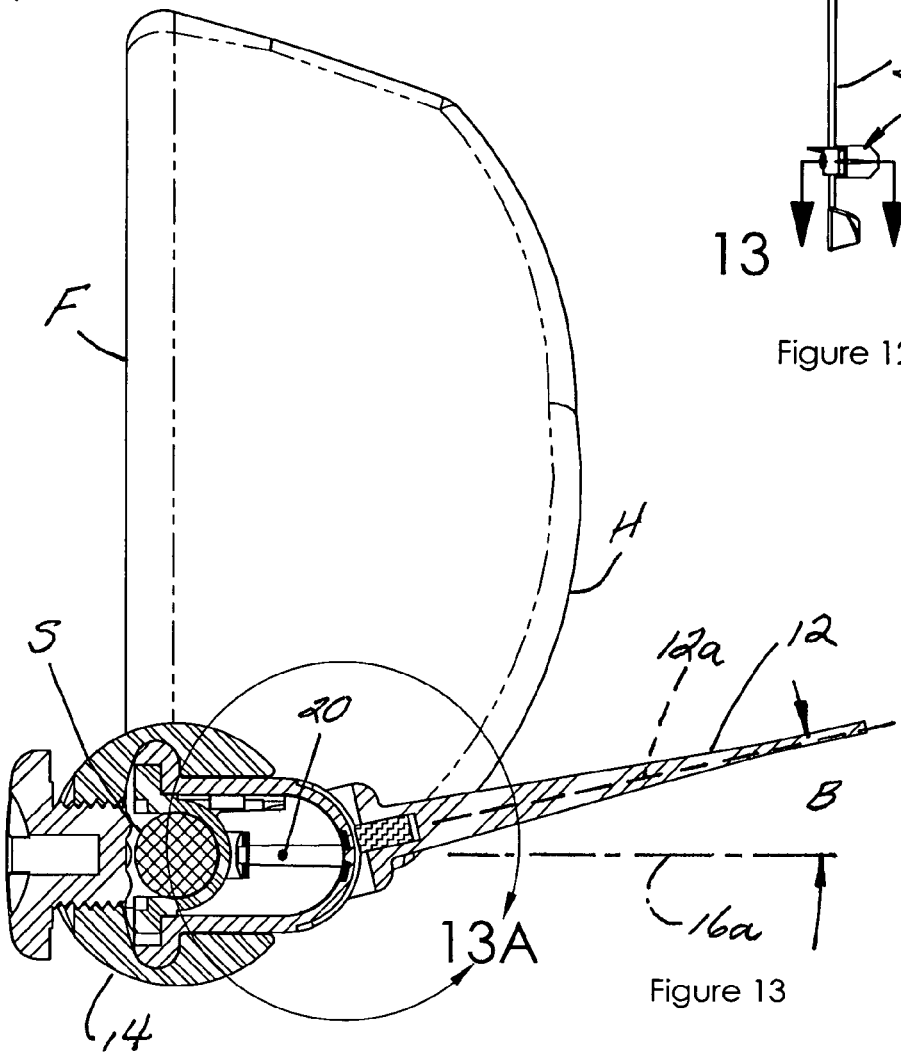
FIG. 13 is a section view in the direction of arrows 13-13 in FIG. 12.

Referring now to FIGS. 12 to 15A, two misalignment orientations of the wind vane 12 are there depicted and correspond to the misalignment shown in FIGS. 5 and 6. In FIGS. 13 and 13A, which correspond to the misalignment configuration shown in FIG. 5, the face F of the club head H is oriented at a deviation angle B with respect to the longitudinal axis 16*a* of the stationary member 16 and the planar axis 12*a* of the wind vane 12. In this configuration of misalignment, the end of magnet 22 is closer to the Hall Effects sensor 26 than it is to Hall Effects sensor 28. This produces a circuit imbalance described generally herebelow which produces a perceivable output signal from the buzzer 46, the emanating sound configured sequentially to advise the golfer of this particular misalignment arrangement and preferably the degree thereof.

Figure 15A:
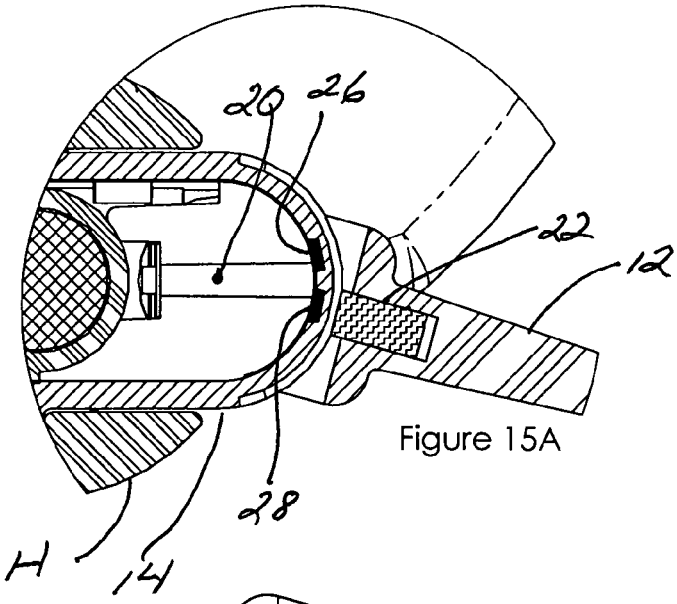
FIG. 15A is an enlargement of area 15A of FIG. 15.
Figure 14:
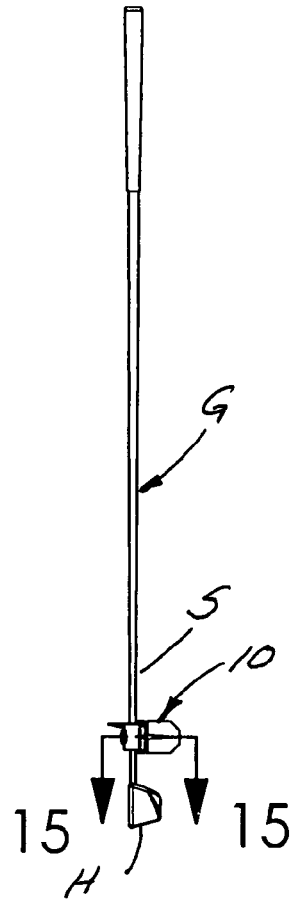
FIG. 14 is a view similar to FIG. 12 showing another condition of misalignment of the golf club head similar to that shown in FIG. 6.
Figure 15:
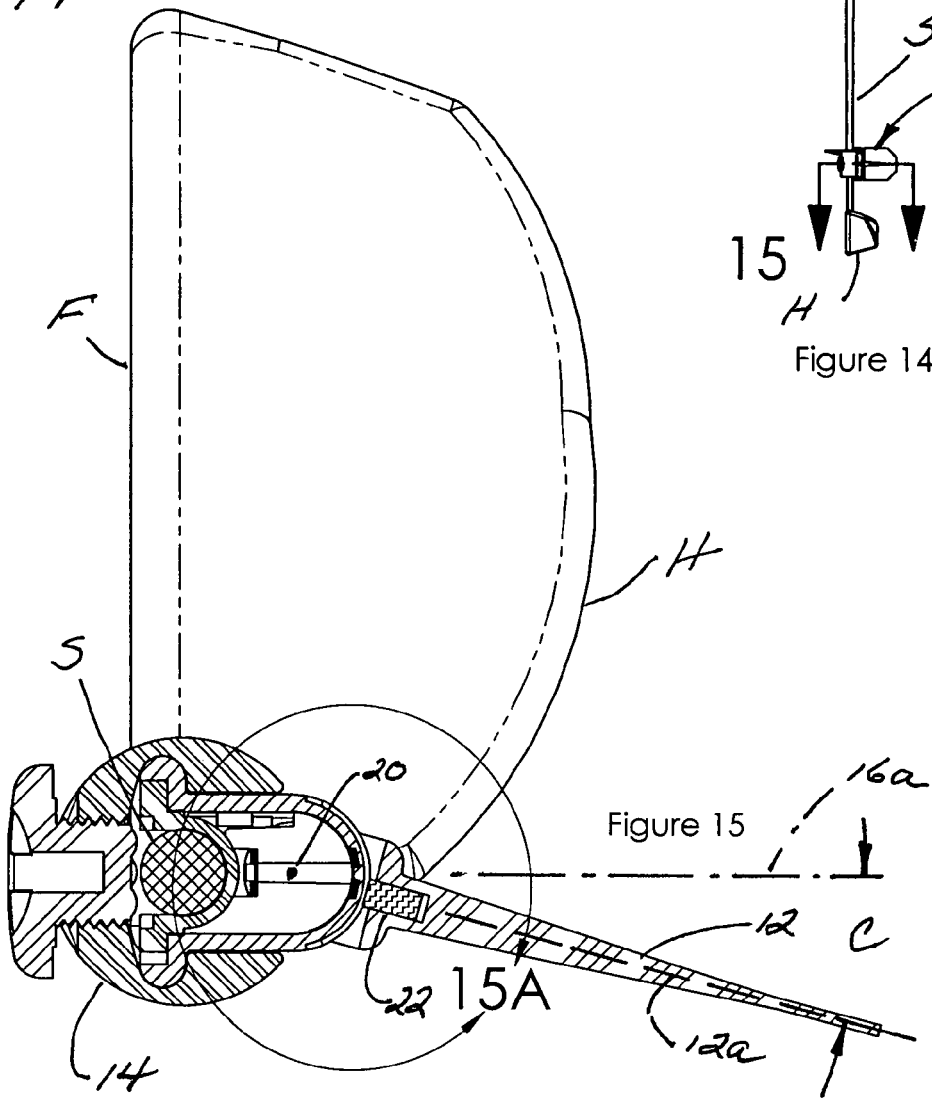
FIG. 15 is a section view in the direction of arrows 15-15 in FIG. 14.

In FIGS. 14, 15 and 15A, the wind vane 12 is oriented at an angle C with respect to the axis 16*a* passing through the axis of rotation 20 and the stationary member 16 corresponding to FIG. 6. As seen in FIG. 15A, the magnet 22 is closer to the Hall Effects sensor 28, causing the electronic circuit to produce a perceivable sound emanating from buzzer 46 which is reflective of this angular magnitude of deviation and the corresponding direction thereof.

Figure 16:
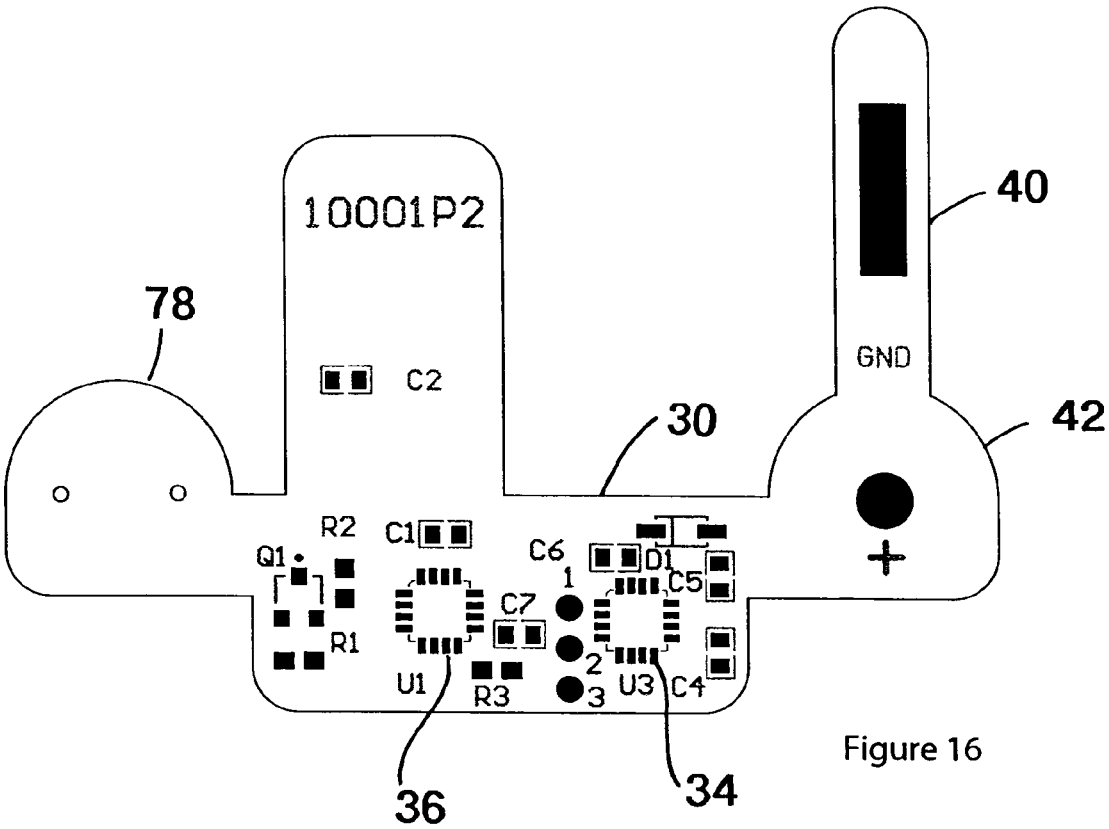
FIG. 16 is a top plan schematic view of the flexible printed circuit board of the preferred embodiment.
Figure 17:
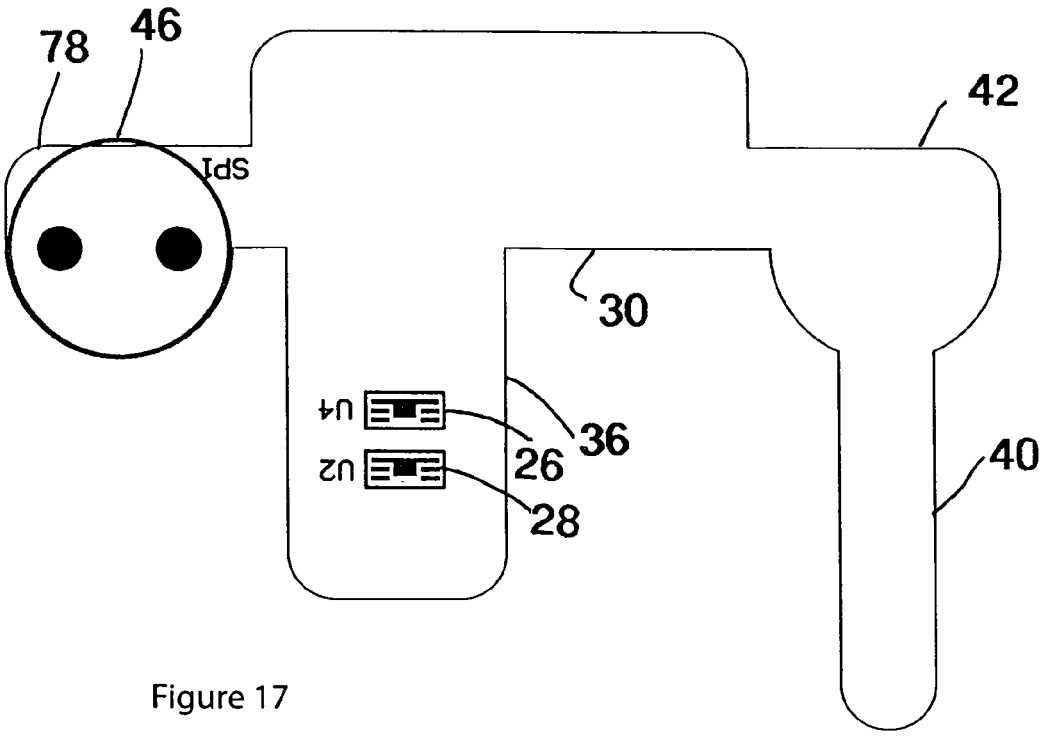
FIG. 17 is a bottom plan view of FIG. 16.

Printed circuit member 30 as best seen in FIGS. 16 and 17 supports the CPU 36 and an accelerometer 34 which is utilized to produce the moment of impact signal of the face F of the club head H against the golf ball. The Hall Effects sensors 26 and 28 are positioned on tab 36 and oriented within the rear housing portion 52 as previously described and with respect to the magnet 22.

Figure 18:
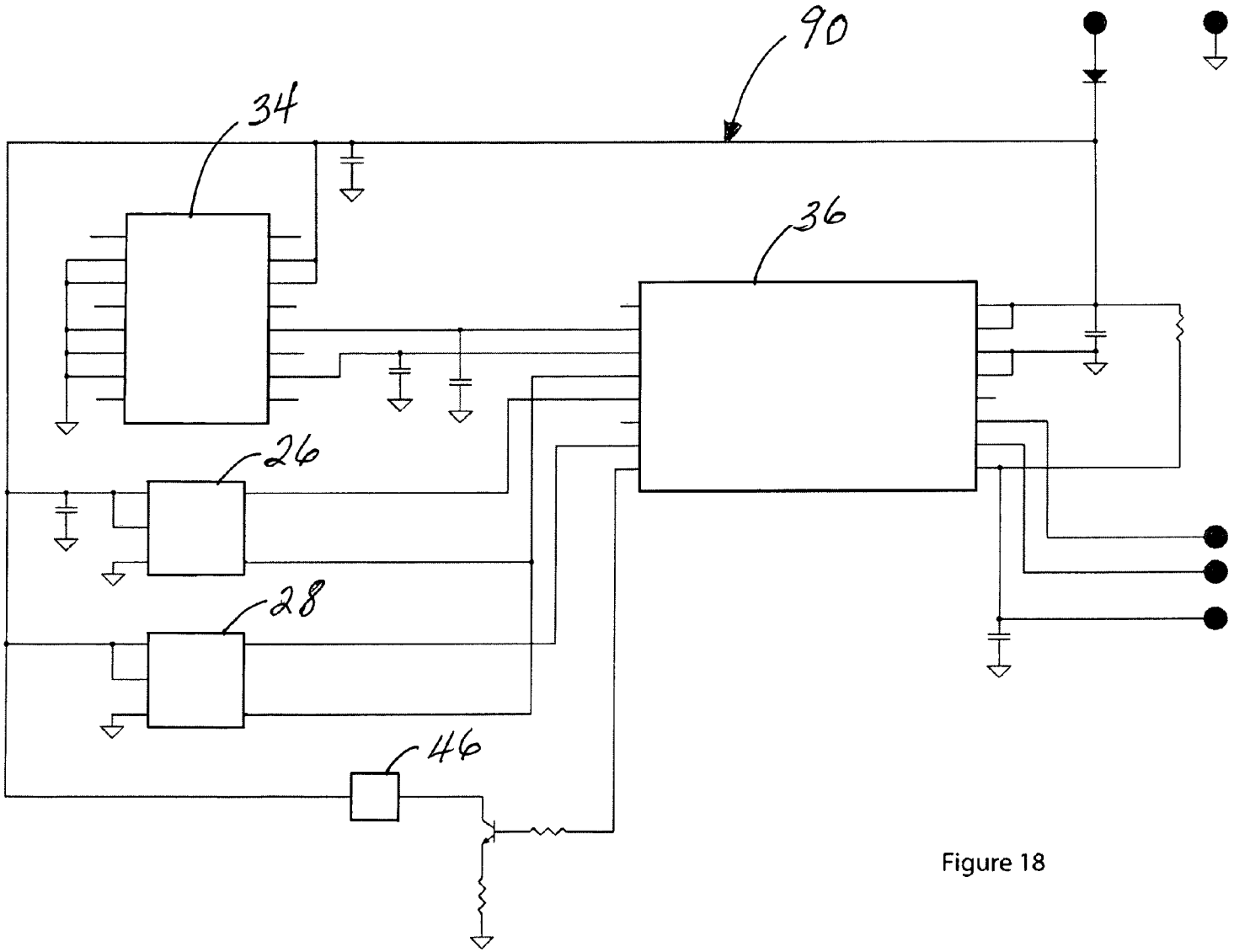
FIG. 18 is a schematic view of the electronic circuit of the preferred embodiment.

In FIG. 18, the preferred embodiment of the electronic circuit is there shown at 90 depicting the approximate orientation of all of the components previously described. The accelerometer 34 is available from Analog Devices Corporation under the part number ADXL.323. The CPU 36 is available through Texas Instruments Corporation under the part number SP430F2002. The buzzer is available under part number SP1 from C.U.I. Corporation.

Note that preferably an audible signal produced by buzzer 46 provides the immediate feedback signal to the golfer with respect to whether the club face F has been held in proper alignment with respect to the direction of swing or whether it has deviated one direction or the other as previously described. However, suitable LED indicators may also be provided and responsive to the circuit output based upon the alignment or misalignment of the magnet and Hall Effect sensors of the electronic circuit as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A golf club swinging guide for a golf club having a shaft with a grip and a head with a striking face, said guide comprising:

a housing having a laterally extending elongated stationary member defining a longitudinal intended line of flight, said housing being attachable to the golf club shaft just above the head of the golf club, said stationary member further including a visual alignment portion which, when aligned perpendicular to the striking face, corresponds to the intended line of flight;

an elongated movable generally planar wind vane connected for free rotation to said housing about an axis of rotation which is generally parallel to the longitudinal axis of the golf club shaft when said housing is attached to the shaft;

said wind vane generally orthogonally extending from said housing in a direction generally opposite to that of said stationary member, said wind vane being freely movably responsive to movement of air flowing therepast during each swing of the golf club to visually align itself about said axis of rotation in the direction of the swing of the golf club;

an electronic circuit within said housing producing a sensorially perceivable signal relative to alignment or misalignment between said stationary member and said wind vane at the moment of impact of the golf club head with a golf ball.

2. A golf club swinging guide for a golf club having a shaft with a grip and a head with a striking face, said guide comprising:

a housing having a laterally extending elongated stationary member, said housing being attachable to the golf club shaft just above the head of the golf club, said stationary member further including a visual alignment portion which is alignable perpendicular to the striking face;

an elongated movable generally planar wind vane connected for free rotation to said housing about an axis of rotation which is generally parallel to the longitudinal axis of the golf club shaft when said housing is attached to the shaft;

said wind vane generally orthogonally extending from said housing in a direction generally opposite to that of said stationary member, said wind vane being freely movably responsive to movement of air flowing therepast during each swing of the golf club to visually align itself about said axis of rotation in the direction of the swing of the golf club;

an electronic circuit within said housing producing a sensorially perceivable output relative to alignment or misalignment between said stationary member and said wind vane at the moment of impact of the golf club head with a golf ball.

3. A golf club swinging guide for a golf club having a shaft with a grip and a head with a striking face, said guide comprising:

a housing including a rear housing portion matably connectable together around, and held firmly with respect to, the shaft just above the head of the head, said housing having a laterally extending elongated stationary member having a visual alignment portion which, when properly aligned, is oriented perpendicular to the striking face;

an elongated movable generally planar wind vane connected for free rotation to said rear housing portion about an axis of rotation which is generally parallel to the longitudinal axis of the golf club shaft when said housing is attached to the shaft;

said wind vane generally orthogonally extending from said rear housing portion in a direction generally opposite to that of said stationary member, said wind vane being freely movably responsive to movement of air flowing therepast during each swing of the golf club to visually align itself about said axis of rotation in the direction of the swing of the golf club;

an electronic circuit held within said housing and producing a sensorially perceivable output relative to alignment or misalignment between said stationary member and said wind vane at the moment of impact of the golf club head with a golf ball.

4. A golf club swinging guide for a golf club having a shaft with a grip and a head with a striking face, said guide comprising:

a housing having a laterally extending elongated stationary member, said housing being attachable to the golf club shaft just above the head of the golf club, said stationary member further including a visual alignment portion which, when properly aligned, is oriented perpendicular to the striking face;

an elongated movable generally planar wind vane connected for free rotation to said housing about an axis of rotation which is generally parallel to the longitudinal axis of the golf club shaft when said housing is attached to the shaft;

said wind vane generally orthogonally extending from said housing in a direction generally opposite to that of said stationary member, said wind vane being freely movably responsive to movement of air flowing therepast during each swing of the golf club to visually align itself about said axis of rotation in the direction of the swing of the golf club;

an electronic circuit held within said housing producing a sensorially perceivable output relative to alignment or misalignment between said stationary member and said wind vane at the moment of impact of the golf club head with a golf ball;

said circuit including a pair of closely spaced Hall Effect sensors within said housing and a magnet within said wind vane in close proximity to each said pair of Hall Effect sensors activating a light or sound emitter which produces said output, said circuit also including an accelerometer for sensing the movement of input between the head and a golf ball during the swing.

* * * * *